US010538935B2

(12) United States Patent
Reyes et al.

(10) Patent No.: US 10,538,935 B2
(45) Date of Patent: Jan. 21, 2020

(54) GUY WIRE ANCHOR SECUREMENT SYSTEM

(71) Applicant: Tower Engineering Solutions, LLC, Las Vegas, NV (US)

(72) Inventors: Jaime Reyes, Grapevine, TX (US); Hanming You, Irving, TX (US)

(73) Assignee: Tower Engineering Solutions, LLC, Las Vegas, NV (US)

( * ) Notice: Subject to any disclaimer, the term of this patent is extended or adjusted under 35 U.S.C. 154(b) by 237 days.

(21) Appl. No.: 15/669,295

(22) Filed: Aug. 4, 2017

(65) Prior Publication Data

US 2019/0040646 A1 Feb. 7, 2019

(51) Int. Cl.
*E02D 5/80* (2006.01)
*E04H 12/20* (2006.01)

(52) U.S. Cl.
CPC ..... *E04H 12/20* (2013.01)

(58) Field of Classification Search
CPC ..... E04H 12/20; E02D 27/42; E02D 5/80; E04B 1/34347
See application file for complete search history.

(56) References Cited

U.S. PATENT DOCUMENTS 1,777,469 A * 10/1930 Luippold ..... E02D 27/42 52/166
2,861,332 A * 11/1958 Hayden ..... E04H 12/20 254/29 R
3,914,910 A * 10/1975 Struben ..... E02D 5/805 52/160
4,037,373 A * 7/1977 Echtler ..... E02D 5/80 411/21
4,180,952 A * 1/1980 Vanderlyn ..... E04B 1/34347 248/508
5,286,142 A * 2/1994 Hoyt ..... E02D 5/80 405/244
6,094,873 A * 8/2000 Hoffman ..... E02D 27/01 52/126.6
7,827,741 B2 * 11/2010 Davies ..... E02D 5/80 248/220.21
8,250,817 B2 * 8/2012 Reyes ..... E02D 5/74 52/146
8,375,651 B2 * 2/2013 Reyes ..... E04H 12/20 52/151
8,458,986 B2 * 6/2013 Reyes ..... E02D 5/74 52/745.21
8,578,665 B2 * 11/2013 Reyes ..... E04H 12/20 52/148
8,745,933 B2 * 6/2014 Reyes ..... E02D 5/74 52/146

(Continued)

*Primary Examiner* — Bradley Duckworth
(74) *Attorney, Agent, or Firm* — BakerHostetler

(57) ABSTRACT

A securement system for a guy wire, the securement system including an anchor assembly including a guy wire coupler and a securement member extending axially outward from the guy wire coupler; the securement member defining an anchor axis, a securing assembly including at least one projection extending outward relative to the shaft; and a block receiving at least the securing assembly therein, the block having an outer surface, wherein the guy wire coupler protrudes from the outer surface of the block; and a base pad extending laterally outward from the block to define at least one channel adjacent to at least one side of the block.

19 Claims, 6 Drawing Sheets

(56) References Cited

U.S. PATENT DOCUMENTS

| | | | | |
|---|---|---|---|---|
| 8,863,455 | B2 * | 10/2014 | Cariaga | E02D 27/02 52/295 |
| 9,359,739 | B2 * | 6/2016 | Clements | E02D 5/80 |
| 9,587,363 | B2 * | 3/2017 | Pedraza | E02D 5/80 |
| 10,030,347 | B2 * | 7/2018 | Kemp | E02D 5/801 |
| 2013/0111829 | A1 * | 5/2013 | Pedraza | E02D 5/80 52/166 |

* cited by examiner

GUY WIRE ANCHOR SECUREMENT SYSTEM

TECHNICAL FIELD

In general, the examples of the disclosure relate to guy wire support structures. More particularly, the examples of the disclosure relate to an anchor for guy wires. Most particularly, the examples of the disclosure relate to a guy wire anchor assembly that includes at least one projection extending outwardly from the guy wire anchor shaft, and a poured concrete form including a wall section that is poured around the shaft embedding the projection therein.

BACKGROUND

A set of guy wires, guy line or guy rope also known simply as a guy, is a tensioned cable designed to stabilize a freestanding structure. Guy wires are often used with masts, wind turbines, utility poles, cell phone towers, and the like. One end of the guy is attached to the structure and the other end is provided with an anchor to secure the free end of the guy and place the guy in tension. The most common type of anchor is a pier or caisson that is driven into the earth having an eye or other attachment point for the free end of the guy. Another common form of anchor is a dead man anchor that uses a buried concrete block, log, or other similar structure that has the guy attached generally pointed to the structure. Often, a stake-like anchor is used to secure the free end of the guy to the dead man structure.

The wireless telecommunications industry has been growing steadily for a number of years. Guyed towers are one of the structures which are widely used in telecommunication industry. A guyed tower typically consist of a guy mast, guy wires, tower base, and guy anchors. Guy wires attach to different levels along its height, and connect to the ground by using guy anchors. Guyed towers rely on guy wires to provide vertical and horizontal supports or resistances to transfer lateral forces to the ground through guy anchors. The members which are connected guy anchor block (or dead man) and guy wires are called anchor shafts. Anchor shafts are used to transfer loads from guy wires to anchor blocks. Therefore, the strength of the anchor shafts is a key factor to ensure the safe of a guyed tower.

Anchor shafts are typically made of steel. The type of shaft shapes could be solid rods, angles, channels, I-beams, flat bars. Since anchor shafts are embedded below grade surface, they are fully exposed to soil. The shafts of guy anchors typically corrode over time. The shaft corrosion primarily affects the area of the shaft where exposes to soil. Corrosion may be caused by the nature of soil, by groundwater, by the electrolytes generated by a battery cell formed between copper grounding and the shafts, or by other factors.

Corrosion may lead to a significant loss of material in the anchor shaft over several years. The loss in section area of the shafts can result in the insufficiency in the tensile strength of the shafts to transmit force to the anchor block. If the strength is inadequate to resist the force from guy wires, the shafts will fail and cause the collapse of the tower.

If a guyed tower collapses, it could damage the facilities in the tower compound area and the properties nearby the tower, and even poses a great risk to human life. The replacing of a collapsed guyed tower is expensive and time consuming.

BRIEF DESCRIPTION OF THE DRAWINGS

So that those having ordinary skill in the art, to which the present disclosure pertains, will more readily understand how to employ the novel system and methods of the present disclosure, certain illustrated embodiments thereof will be described in detail herein-below with reference to the drawings, wherein.

SUMMARY

Figure 1:
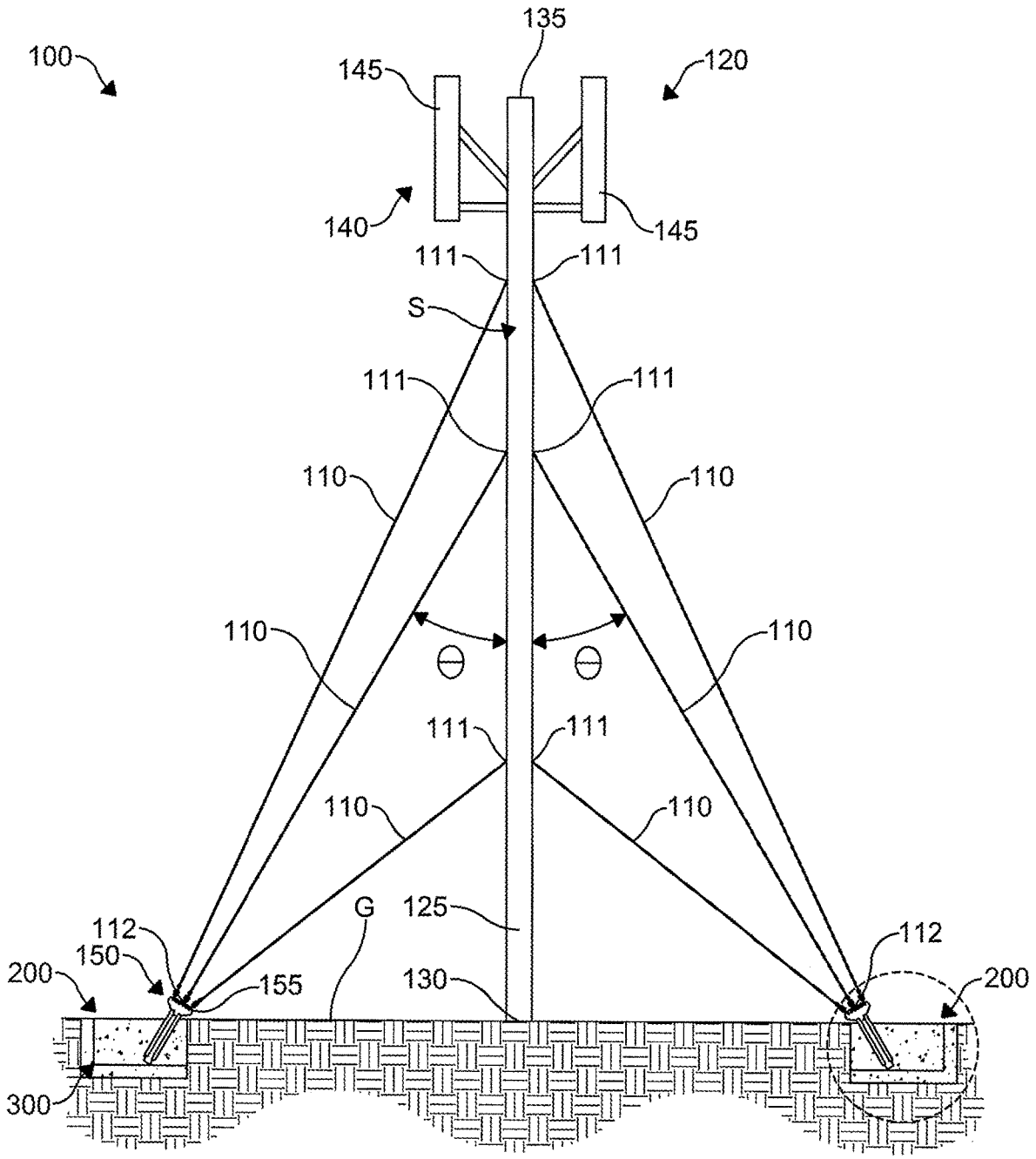
FIG. 1 is a partially schematic side view of a structure supported by guy wires and a securement system according to examples of the disclosure.

An example generally includes a securement system for a guy wire, the securement system comprising a first securement member and a second securement member, the first securement member and second securement member extending parallel to each other defining an anchor axis therebetween. The first securement member and second securement member are spaced from each other to define an anchor gap. The first securement member and second securement member each include an anchor coupler portion and a securing portion. The example also includes a first securing assembly extending laterally outward from the securing portion of the first securement member and a second securing assembly extending laterally outward from the securing portion of the second securement member, where the first securing assembly and second securing assembly each include at least one bearing surface that extends normal to the anchor axis.

According to another example, a securement system for a guy wire comprises an anchor assembly including a guy wire coupler and a securement member extending axially outward from the guy wire coupler, the securement member defining an anchor axis, a securing assembly including at least one projection extending outward relative to the shaft, and a block receiving at least the securing assembly therein, the block having an outer surface, wherein the guy wire coupler protrudes from the outer surface of the block; and a base pad extending laterally outward from the block to define at least one channel adjacent to at least one side of the block.

Yet another example provides a method of securing a guy wire comprising providing a securement system including a at least one securement member having an anchor portion and a securing portion, the securing portion defining an anchor axis, and at least one securing surface extending outward from the securing portion, placing the securing portion within a curable material, and curing the curable material to form a block with the securing portion encased therein, wherein the anchor portion extends outward of the block.

DETAILED DESCRIPTION

A variety of structures may be supported by guy wires. The guy wire or simply a guy is attached to the structure at one end and an anchor at the opposite end. The anchor keeps the guy in tension to support the structure. Typically multiple guy wires are used to support the structure and accommodate varying loads on the structure including but not limited to wind loading and the like. As noted, in a typical guy anchor, the anchor is driven into the ground or otherwise exposed to dirt and soil. Water runoff, minerals in the soil, and electrolytic circuits created in the soil can cause corrosion that weakens the anchor over time. A securement system is provided to improve or replace traditional anchors is provided. The securement system may be used as part of a guy assembly to support a structure and generally includes a securing members with projections that better anchor the guy. In additional examples, the portions of the securing members having the projections are embedded in a molded material such as a concrete to secure the guy and prevent the anchor from coming in contact with soil. These and other examples are described more completely below.

Figure 1A:
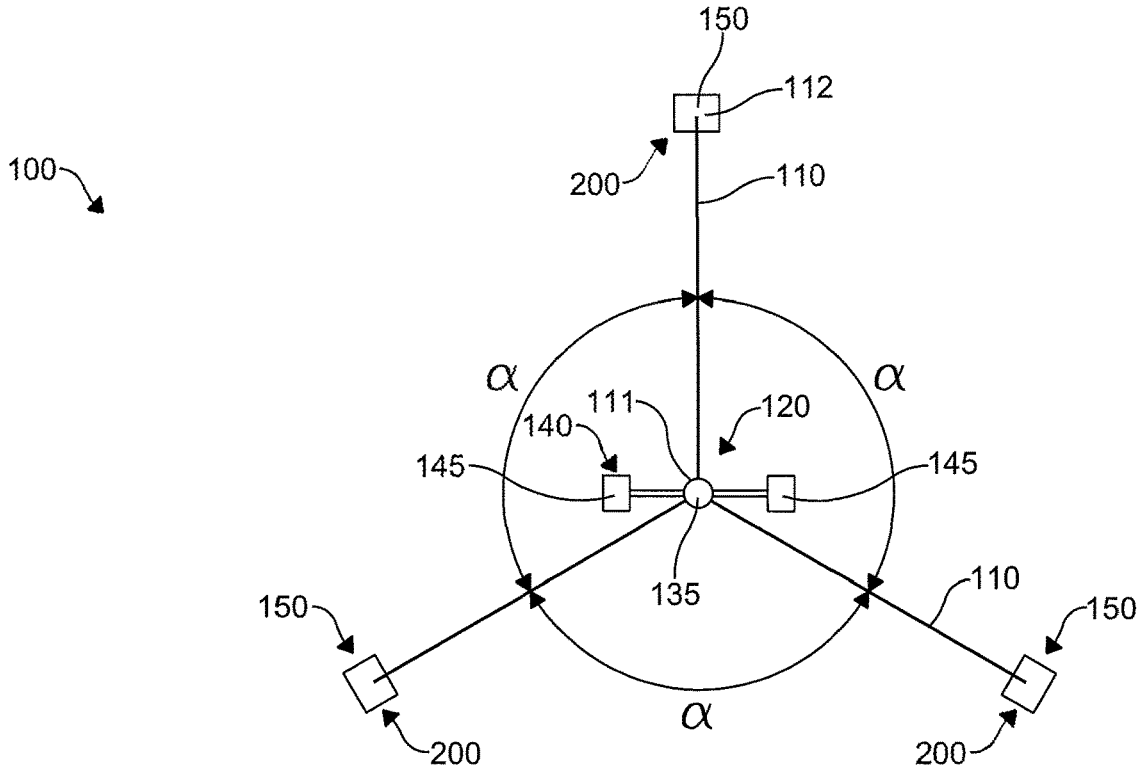
FIG. 1A is a partially schematic top view thereof.

A guy assembly is generally indicated by the number 100 in the accompanying drawings. The guy assembly generally includes at least one guy wire 110. Guy wire 110 includes a first end 111 and a second end 112. The first end 111 may be attached to a structure S supported by the guy wire assembly 100. The second end 112 of guy wire 110 is anchored to place the guy wire in tension to support the structure S. Guy wire 110 may extend at any angle between the structure S and an anchor assembly depending on the expected loading of the structure S and other supporting devices that may be used in conjunction with guy wire 110. In the depicted example, structure S is supported by multiple guy wires 110 spaced circumferentially at a selected angle $\alpha$ (FIG. 1A) and extending from structure S toward ground G at a second angle. In the example shown, structure S is supported by three guy wires 110 spaced at a first angle $\alpha$ of about 120°. In this example, the circumferential angle $\alpha$ between guy wires 110 is equal. In other examples, the circumferential angle $\alpha$ between guy wires may vary. The guy wires form a second angle with structure generally indicated by the symbol $\theta$. In the example shown, each guy wire 110 forms the same angle $\theta$. In other examples, the angle $\theta$ between the guy wire and the structure S may vary. For example, the ground surface may be uneven causing one wire to extend at a different angle than the other, or the guy wires may be anchored to different structures.

Structure S may be any free standing structure that requires support. Typical structures include generally slender, free standing structures, such as masts, poles, towers, and the like. By slender, it is meant that the height of the structure is generally greater than the width, or diameter. In the example, structure S is a telecommunications tower and is generally indicated by the number 120. Tower 120 may include a mast 125 having a base 130 and a tip 135. Various equipment, generally indicated at 140, may be supported on structure S including but not limited to communications equipment 145, such as, antennae, transmitters, receivers, digital signal processors, controllers, GPS receivers and the like.

Figure 2:
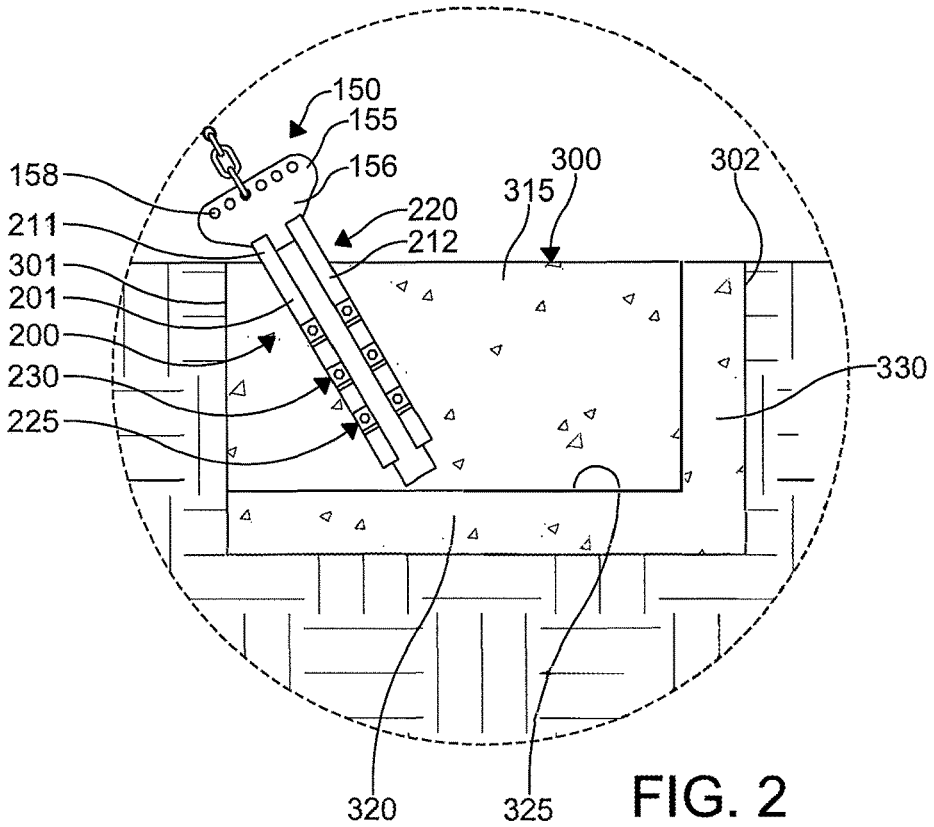
FIG. 2 is an enlarged side elevational view of the area circled in FIG. 1 showing details of a securement system according to one example of the disclosure.

Guy wires 110 may be attached to different levels along the height of mast 125 and connect to the ground G using a guy anchor. The guy wires 110 help the tower 120 resist lateral and vertical uplift forces by anchoring the tower to the ground G. To anchor the guy wire 110, an anchor assembly generally indicated by the number 150 may include a guy coupler 155 and an anchor shaft 160. The guy coupler 155 attaches to second end 112 of guy wire 110. Coupler 155 may include a structure to facilitate attachment of the guy wire 110 to the anchor assembly 150. For example, coupler 155 may include a plate 156 to which the guy wire is attached by a suitable fastener, including but not limited to, a bolt, a weld, a clasp, an eye, and the like. In the example, plate 156 may be provided with one or more receivers to facilitate use of a fastener to attach the guy 110 to the plate 156. For example, as best shown in FIG. 2, plate 156 may include plural spaced openings 158. In the example, the openings 158 are circular and of equal diameter. It will be understood that different shape and sizes of openings may be used depending on the fastener. In the example, openings 158 are arranged in a row across the top of plate 156, but it will be understood that other arrangements of the openings may be used.

Guy 110 may be attached to guy coupler 155 in various ways depending on the type of coupler used. In general, guy 110 is attached to guy coupler by a guy fastener 161, which may include a weld, a bolt, a clasp, and the like. Guy may be fastened directly to guy coupler 155 by threading a portion of guy cable through an opening and securing it to itself, welding an end of guy 110 to guy coupler 155, bolting an end to guy coupler 155, or clamping an end of guy 110 to guy coupler with a clasp. Alternatively, attachment may include intermediate components that attach guy 110 to coupler 155. In these instances, guy fastener includes the intermediate component that facilitates attachment of guy to guy coupler 155.

Figure 5:
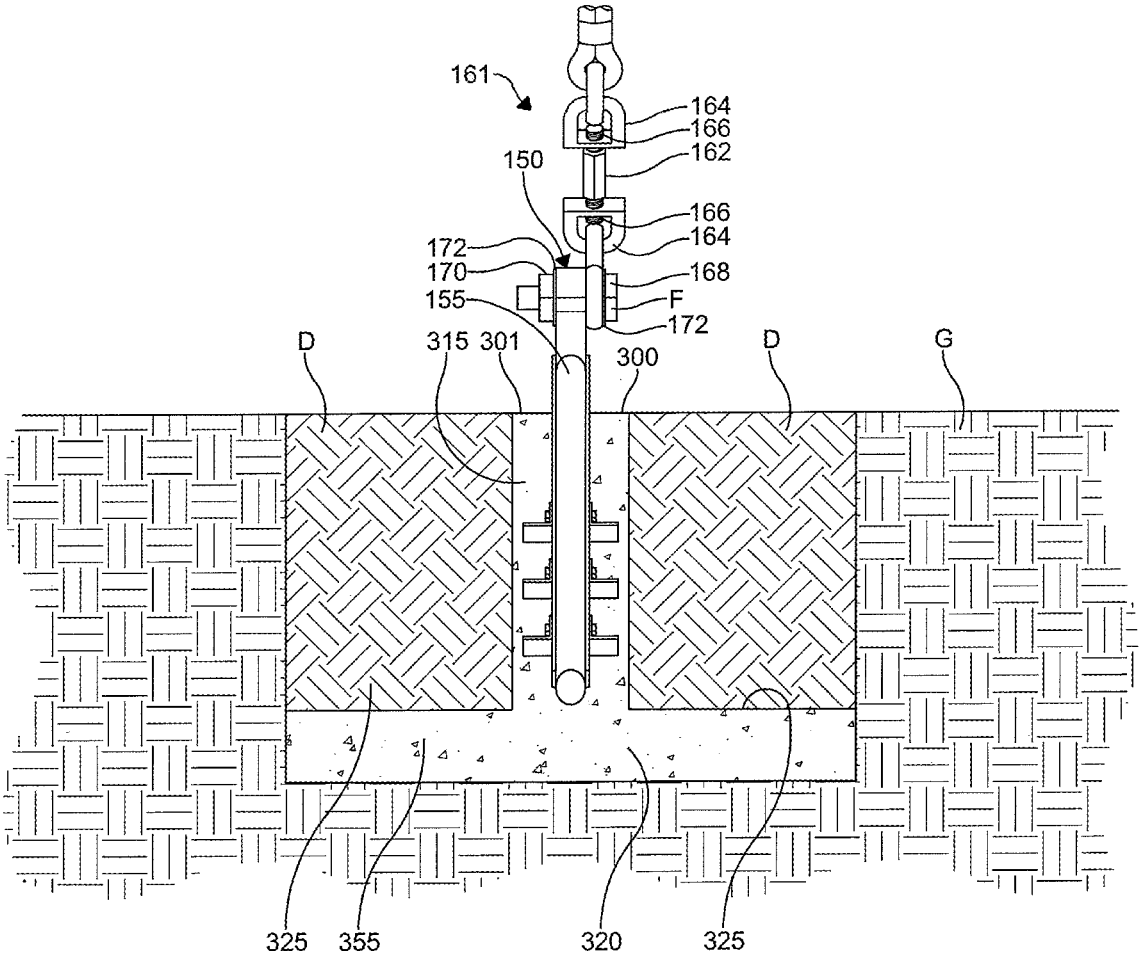
FIG. 5 is a partially schematic cutaway view depicting details of a securement system according to an example.

In the example shown in FIG. 5, guy fastener 161 includes a turnbuckle to allow adjustment of the tension on guy 110. Turn buckle includes a body 162 that threadably supports two eyes 164 that have threaded shafts 166 extending therefrom. The shafts 166 thread into the body 162 at opposite ends and may be rotated to adjust the tension on guy 110 as needed. In the example one eye 164 is affixed to plate 156 by a fastener F including but not limited to a bolt, a weld, a clasp, and the like. The guy 110 is attached to the opposite eye 164. In the example, fastener F is a bolt 168 extending through eye 164 and plate 156. Bolt 168 may be secured by a nut 170 and washers 172 may be provided to facilitate attachment. Safety lines and ground wires may also be attached as needed.

As noted, guy wires 110 are often anchored to the ground by anchors that are driven into the ground. The anchors are typically made of steel and corrode from exposure to minerals, waters and electrolytic charges within the soil. To address corrosion, anchor shafts are often replaced with new anchors such as pier foundations or concrete dead men. These approaches generally require replacing all of the guy wires or re-attaching existing guy wires to new anchors.

According to an example of the disclosure, a securement system, generally indicated by the number 200 is provided. Securement system 200 includes at least one securement member that extends axially outward relative to a guy coupler. As discussed more completely below, securement system 200 may be retrofit to an existing anchor or replace an existing anchor. Therefore, guy coupler may be an existing guy coupler 155 on an anchor to which the system 200 is retrofit or guy coupler 155 may be part of system 200.

With reference to FIG. 2, one example of a securement system 200 is shown. In this example, securement system 200 is used in connection with an anchor assembly having a guy coupler plate 156 and shaft. Securement system 200 includes at least one securement member 210 that attaches to coupler plate 156 and extends axially outward therefrom. In the example, a first securement member 211 and a second securement member 212 are provided. First securement member 211 and second securement member 212 are spaced from each other to define an anchor gap 216. The first securement member 211 and second securement member 212 are arranged parallel to each other and an anchor axis A. In the example, anchor axis A is defined between first securement member 211 and second securement member 212 and extends through the center of shaft 160.

Figure 6:
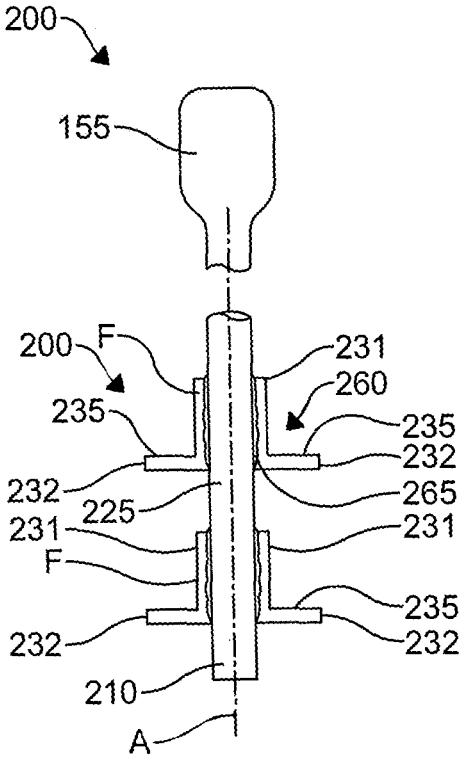
FIG. 6 is a partially fragmented side elevational view of a securement system according to another example of the disclosure.

Securement member 210 may include an anchor portion 220 at one end that attaches to a guy coupler 155 on an existing anchor in a retrofit example. Alternatively, system 200 may include an anchor to which securement member 210 is attached as shown. Or, as a further alternative, securement member 210 may be provided with an integral guy coupler according to another example (FIG. 6). A securing portion 225 is located axially outward relative to anchor portion 220. Securing portion 225 includes at least one securing assembly, generally indicated by the number 230. Securing assembly 230 generally includes one or more projections 260 that form a bearing surface 235 that extends normal to the anchor axis A. In the example, securing assembly 230 includes L-shaped projections 260 that have a first leg 231 and a second leg 232. The first leg 231 is attached to securement member 210 by a fastener F, such as a bolt, a weld or the like. Second leg 232 extends at a right angle to first leg 231 defining bearing surface 235.

Figure 3:
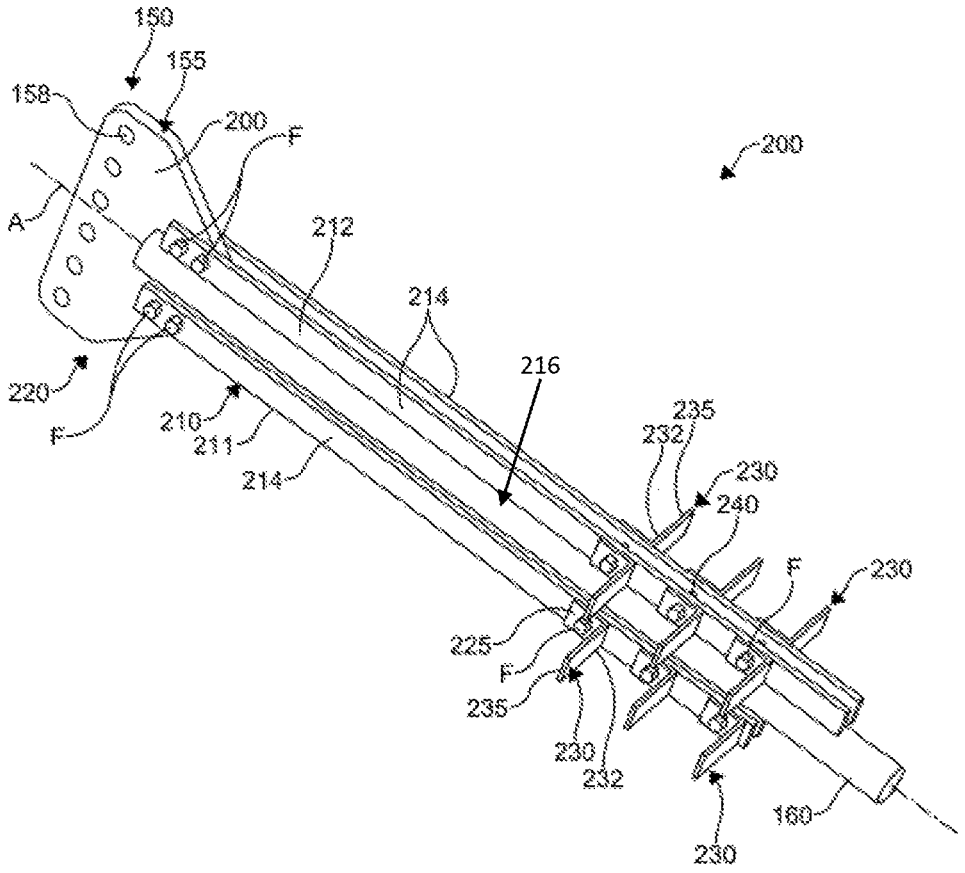
FIG. 3 is a perspective view of a securement system according to another example of the disclosure.

As further shown in the example depicted in FIG. 3, first securement member 211 and second securement member 212 may be formed from a one or more rods or plates 214. In the example, two plates are used to form each securement member 210. As shown, securing assembly 230 may include pairs of L-shaped members attached back to back on each of the plates 214. A spacer 240 may be provided between each plate 214 to facilitate attachment of L-shaped members. In the example, each securement member 210 is provided with three pairs of L-shaped plates.

It will be understood that other projections 260 may be used to form bearing surface 235. Bearing surface 235 is used to assist the anchor in resisting forces created by the guy wire 110. The anchor shaft 160 without bearing surface 235 relies on friction forces to resist tension forces created by guy wire 110. Bearing surface 235 provides further resistance by providing a surface that more directly resists forces created by guy wire 110. Bearing surface 235 may extend generally normal to anchor axis A to provide a surface that bears against surrounding structures to and provide a reaction force opposite tension forces along guy wire 110. The projections shown in the figures generally include a bearing surface 235 that is flat and formed normal to axis A, but any shape that helps resist forces on anchor are suitable. Therefore, the examples shown should not be considered limiting.

Figure 4:
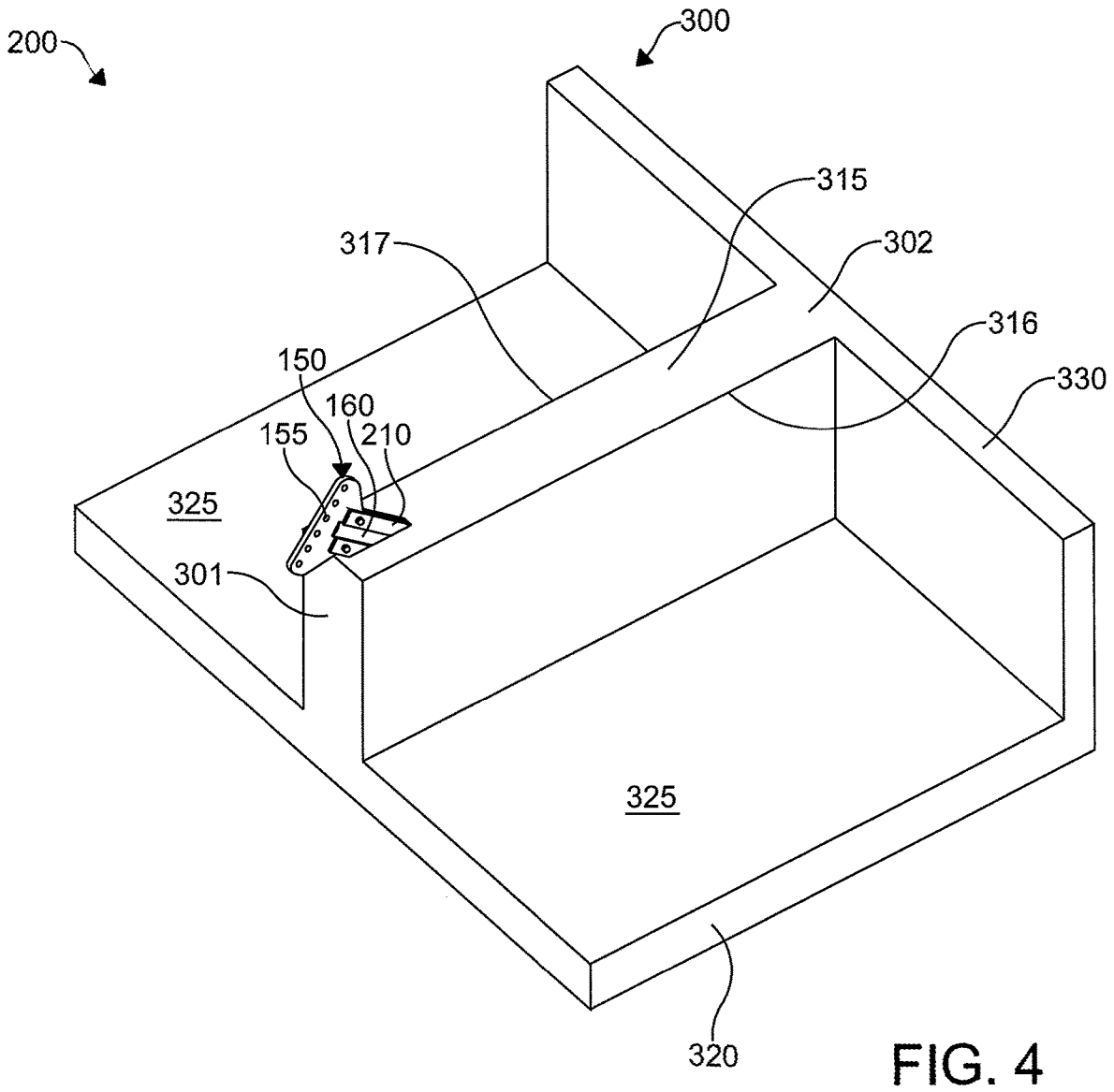
FIG. 4 is a perspective view of a securement system according to another example.

With reference to FIG. 4, securement system 200 may further include a block, generally indicated by the number 300. Block generally includes a first end 301 and a second end 302, and may be used to embed securing portion 225 of securement member 210 therein, as described more completely below. In the example, block 300 is provided with an upstanding portion 315 that receives the securing portion 225 at first end 301 encasing it within the block material to prevent contact with soil. As a further alternative, block 300 may include a base pad 320 that extends laterally outward from at least one side 316,317 of upstanding portion 315. As shown, base pad 320 is located at a lower end 318 of upstanding portion 315 such that base pad 320 forms at least one open channel 325 adjacent to upstanding portion 315. Dirt D or other fill material may fill each channel 325 and cover base pad 320 to secure and weigh down block 300.

Block 300 may also include a back wall 330 extending laterally outward from at least one side of block 300 at second end 302. Back wall 330 may extend to the same extent as base pad 320. Back wall 330 may also have the same height as upstanding portion 315, as shown. Alternatively, back wall 330 may extend to a greater or lesser extent than base pad 320 or a greater or lesser height than upstanding portion 315. In the example, back wall 320 extends upwardly from base pad 320 closing channel 325 at the second end 302 of block 300. As shown, back wall 330 is located at an opposite end relative to securement member 210 and guy coupler 155. Tension applied to guy coupler 155 via guy 110 is, thus, further resisted by the weight of the dirt D or fill within channel 325 against back wall 330.

As best shown in FIGS. 4 and 5, according to an example, securing portion 225 is embedded or encased within block 300. Block 300 may be formed from any moldable material to facilitate encasing securing portion 225 therein. Such materials may include metals, plastics, or cementitious materials such as concrete. These materials may be reinforced or unreinforced. In the example, block 300 is constructed of concrete or cement 355. Block 300 may be molded within a form as a single integral shape, or constructed by attaching discrete portions together. When forming the portion that defines block 300, securing portion 225 may be inserted within the uncured cement or cement poured around the securing portion 225 to encase at least a portion of securing portion 225 within the cement 355, as best seen in FIG. 4.

As discussed, when securing guy wire 110, block 300 may be buried, or dirt D or other fill may be placed within channel(s) within block 300 to weigh it down and help resist forces transmitted through the guy wire 110 to securement system 200. By embedding at least the securing portion 225 within block 300, contact between the soil and securing members 210 or shaft 160, which are prone to corrosion, is minimized. It will be understood that form may be brought to the site such that an existing anchor may be retrofit with a securement system 200 that includes block 300. Alternatively, block 300 may be cast offsite with securement member 210 embedded therein and brought to the site for attachment to the guy wire 110.

In the example shown in FIGS. 2-5, guy coupler 155 is exposed from block 300, and guy wire may be attached to guy coupler 155 by a fastener F including but not limited to a bolt, weld, clasp or the like. As discussed, securement system 200 shown in these figures may be a standalone unit or retrofit to an existing anchor. Examples shown in FIGS. 5-8, include alternative securement member configurations that replace an existing anchor. In these examples, a securement member 210 extends axially outward from an integral or attached guy coupler 155. A securing portion 225 of securement member 210 includes one or more projections 260 that form bearing surface 235.

With reference to FIG. 6, a securement system 200 according to another example is shown. Securement system 200 in this example securement member 210 is a central shaft with a guy coupler 155 attached thereto or integrally formed therewith. Projections 260 are attached directly to securement member 210 as by a weld 265. In this example, projection 260 is an 1-shaped member similar to those discussed in FIG. 2.

Figure 7:
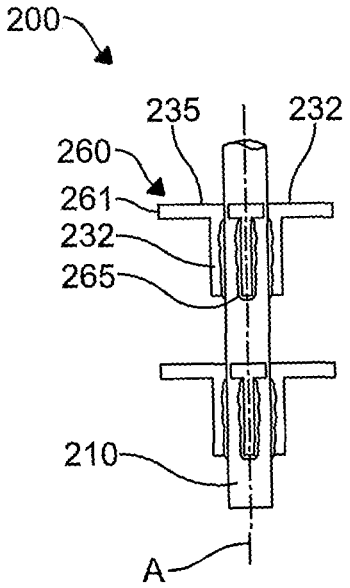
FIG. 7 is fragmented side elevational view similar to FIG. 6 showing a further example of a securement system.

With reference to FIG. 7, another example of a securement system 200 is shown. As in FIG. 6, securement member 210 is a central shaft. Projections 260 extend radially outward from securement member 210. In this example, projections 260 extend outward from shaft about the circumference of shaft and are spaced relative to each other at 90 degree angles. As in previous embodiments, projections are generally l-shaped with a first leg 231 attached to securement member by a fastener F, which in the example is a weld. 265. Second leg 232 extends outward from first leg to define a bearing surface 235. In the example, second leg 232 extends at generally a 90 degree angle anchor axis A. Other angles between 0 and 180 degrees relative to anchor axis A may be used in any of the examples depicted or discussed herein. Likewise, greater or fewer projections 260 may be used than those shown in the figures.

Figure 8:
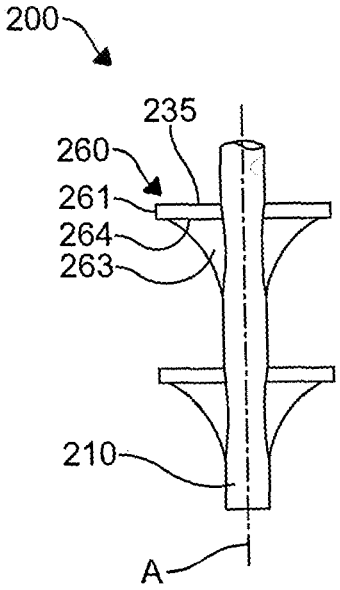
FIG. 8 is a fragmented side view similar to FIG. 7 showing still a further example of a securement system.

With reference to FIG. 8, still another example of a securement system 200 is shown. As in example 6, securement member 210 is formed as a central shaft. Projections 260 extend outward from securement member 210. In this example, projections 260 are formed integrally with securement member 210 as by casting, forging or other suitable process. In the example, projection 260 includes a plate 261 extending outward at approximately a 90 degree angle relative to anchor axis A. Other angles relative to anchor axis between 0 and 180 degrees may also be used. Plate 261 may be reinforced by a gusset 263 extending between securement member 210 and a lower surface 264 of plate 261.

Figure 9:
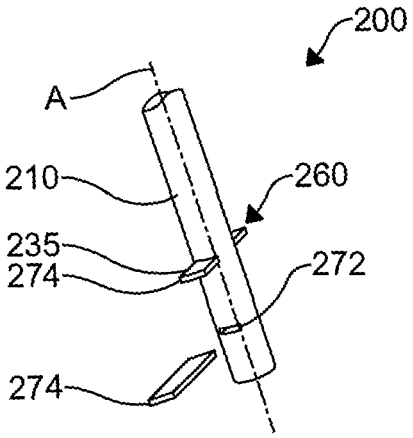
FIG. 9 is a fragmented assembly view showing yet a further example of a securement system.

With reference to FIG. 9, another example of a securement system 200 is shown. As in the examples depicted in FIGS. 6-8, securement member 210 is a central shaft. In this example, projection 260 includes a cross-bar assembly 270 that includes an opening 272 extending through securement member 210 in which a cross-bar 274 is received. Cross-bar 274 may have any cross-sectional shape including the rectangular shape shown. Opening 272 may generally conform to the cross-sectional shape of cross-bar 274 or have a different shape if other components or filler material are used. To facilitate transport, cross-bar 274 is removable from opening 272 and may be fixed upon curing of the material forming block 300. Alternatively, cross-bar 274 may be secured relative to securement member 210 with a fastener including but not limited to a bolt, a clamp, a weld or the like. Alternatively, an interference fit may be used to hold cross-bar 274 until it is encased within block 300.

EXAMPLES

Example 1

A securement system for a guy wire, the securement system comprising: a first securement member and a second securement member, the first securement member and second securement member extending parallel to each other defining an anchor axis therebetween, wherein the first securement member and second securement member are spaced from each other to define an anchor gap, and wherein the first securement member and second securement member each include a anchor coupler portion and a securing portion; a first securing assembly extending laterally outward from the securing portion of the first securement member and a second securing assembly extending laterally outward from the securing portion of the second securement member; wherein the first securing assembly and second securing assembly each include at least one bearing surface that extends radially outward to the anchor axis.

Example 2

The securement system of example 1, wherein the bearing surface extends normal to the anchor axis.

Example 3

The securement system of example 1, the first securing assembly includes a pair of 1-shaped members, each 1-shaped member having a first leg and a second leg, wherein the first leg is attached to the securing portion of the first securement member and the second leg extends outward from the first leg to form the at least one bearing surface; and the second securing assembly includes a second pair of l-shaped members, each 1-shaped member having a first leg and a second leg, wherein the first leg is attached to the securing portion of the second securement member and the second leg extends outward from the first leg to form the at least one bearing surface.

Example 4

The securement system of example 1 further comprising a securing block formed about the securing portion of the first securement member and second securement member, the securing block having an upper surface, wherein the first securing assembly and second securing assembly are encased within the securing block below the upper surface, and wherein the anchor coupler portion of each of the first securement member and second securement member extends upward and outward from the upper surface of the securing block; the securing block including a base pad extending laterally outward from the securing block to define at least one channel adjacent to at least one side of the securing block.

Example 5

The securement system of example 4, further comprising a back wall extending laterally outward from one end of the securing block and upward from the base pad to close the at least one channel at one end.

Example 6

The securement system of example 5, wherein the anchor coupler portion extends away from the back wall.

Example 7

The securement system of example 4 wherein the securing block is centered on the base pad, the base pad defining a first channel adjacent to one side of the securing block and a second channel adjacent to a second side of the securing block.

Example 8

The securement system of example 1 further comprising an anchor assembly including a guy coupler having an anchor shaft extending axially outward therefrom, wherein the first securement member and second securement member attach to the guy coupler and the anchor shaft extends into the anchor gap.

Example 9

The securement system of example 1 further comprising a guy wire coupled to the first securement member and the second securement member.

Example 10

The securement system of example 9, wherein the first securement member and the second securement member are attached to an anchor plate extending therebetween, and the guy wire is secured to the anchor plate.

Example 11

The securement system of example 10, wherein the anchor plate includes a pair of first receivers and a pair of second receivers spaced laterally from each other an equal distance from the anchor axis, and wherein the first securement member is attached to the anchor plate by a pair of fasteners received within the pair of first receivers; and wherein the second securement member is attached to the anchor plate by a pair of second fasteners received within the pair of second receivers.

Example 12

A securement system for a guy wire, the securement system comprising: an anchor assembly including a guy wire coupler and a securement member extending axially outward from the guy wire coupler; the securement member defining an anchor axis, a securing assembly including at least one projection extending outward relative to the shaft; and a block receiving at least the securing assembly therein, the block having an outer surface, wherein the guy wire coupler protrudes from the outer surface of the block; and a base pad extending laterally outward from the block to define at least one channel adjacent to at least one side of the block.

Example 13

The securement system of example 12 further comprising a back wall extending laterally outward from one end of the block and upward from the base pad to close the at least one channel at one end.

Example 14

The securement system of example 13, wherein the guy wire coupler extends outward from the block away from the back wall at an acute angle relative to the upper surface.

Example 15

The securement system of example 12, wherein the anchor axis extends at an acute angle relative to the upper surface of the block.

Example 16

The securement system of example 12, wherein the at least a portion of the shaft and securing assembly are encased in the block.

Example 17

A method of securing a guy wire comprising: providing a securement system including a at least one securement member having an anchor portion and a securing portion, the securing portion defining an anchor axis, and at least one securing surface extending outward from the securing portion; placing the securing portion within a curable material and curing the curable material to form a block with the securing portion encased therein, wherein the anchor portion extends outward of the block.

Example 18

The method of example 17, wherein the block is attached to a base pad extending laterally outward relative to the block to form a channel adjacent to at least one side of the block.

Example 19

The method of example 18 further comprising attaching a back wall at one end of the block, wherein the back wall extends upward relative to the base pad to close one end of the channel.

Example 20

The method of example 17, wherein the form defines an upper surface of the block and wherein the anchor axis extends at an acute angle relative to the upper surface.

What is claimed:

1. A securement system for a guy wire, the securement system comprising:

a first securement member and a second securement member, the first securement member and second securement member extending parallel to each other and defining an anchor axis therebetween, wherein the first securement member and second securement member are spaced from each other to define an anchor gap, and wherein the first securement member and second securement member each include an anchor coupler portion and a securing portion opposite the anchor coupler portion; and a block attached to the securing portion of the first and second securement members, the block comprising:

a base pad defining a first side, a second side opposite the first side along a first direction, and an upper surface; and a first portion extending upwards from the upper surface of the base pad and defining a first side, a second side opposite the first side along the first direction, and an upper surface opposite the base pad that extends from the first side of the first portion to the second side, wherein the first and second sides of the first portion are positioned between the first and second sides of the base pad along the first direction, wherein the anchor coupler portions of the first and second securement members are positioned above the upper surface of the first portion of the block.

2. The securement system of claim 1, further comprising:

a first securing assembly extending laterally outward from the securing portion of the first securement member and a second securing assembly extending laterally outward from the securing portion of the second securement member, wherein the first securing assembly and second securing assembly each include at least one bearing surface that extends radially outward relative to the anchor axis, wherein the at least one bearing surface extends normal to the anchor axis.

3. The securement system of claim 2, the first securing assembly includes a pair of L-shaped members, each L-shaped member having a first leg and a second leg, wherein the first leg is attached to the securing portion of the first securement member and the second leg extends outward from the first leg to form the at least one bearing surface; and the second securing assembly includes a second pair of L-shaped members, each L-shaped member having a first leg and a second leg, wherein the first leg is attached to the securing portion of the second securement member and the second leg extends outward from the first leg to form the at least one bearing surface.

4. The securement system of claim 1, wherein the block further comprises a back wall extending laterally outward from one end of the first portion and upward from the base pad.

5. The securement system of claim 4, wherein the anchor coupler portion extends away from the back wall.

6. The securement system of claim 4, wherein the first portion is centered on the base pad, the base pad defining a first channel adjacent to the first side of the first portion and a second channel adjacent to the second side of the first portion.

7. The securement system of claim 1, further comprising an anchor assembly including a guy coupler plate having an anchor shaft extending axially outward therefrom, wherein the first securement member and second securement member attach to the guy coupler plate and the anchor shaft extends into the anchor gap.

8. The securement system of claim 1, further comprising a guy wire coupled to the first securement member and the second securement member.

9. The securement system of claim 8, wherein the first securement member and the second securement member are attached to a guy coupler plate extending therebetween, and the guy wire is secured to the guy coupler plate.

10. The securement system of claim 9, wherein the guy coupler plate includes a pair of first receivers and a pair of second receivers spaced laterally from each other an equal distance from the anchor axis, and wherein the first securement member is attached to the guy coupler plate by a pair of fasteners received within the pair of first receivers; and wherein the second securement member is attached to the guy coupler plate by a pair of second fasteners received within the pair of second receivers.

11. A securement system for a guy wire, the securement system comprising:

an anchor assembly including a guy coupler plate;

a securement member extending axially outward from the guy plate, the securement member defining an anchor axis; and a block attached to the anchor assembly and the securement member, the block comprising:

a base pad defining a first side, a second side opposite the first side along a first direction, and an upper surface; and a first portion extending upwards from the upper surface of the base pad and defining a first side, a second side opposite the first side, and an upper surface opposite the base pad that extends from the first side of the first portion to the second side, wherein the first and second sides of the first portion are positioned between the first and second sides of the base pad, wherein the guy coupler plate is positioned above the upper surface of the first portion.

12. The securement system of claim 11, wherein the block further comprises a back wall extending laterally outward from one end of the first portion and upward from the base pad.

13. The securement system of claim 12, wherein the guy coupler plate extends outward from the block away from the back wall at an acute angle relative to an upper surface of the first portion.

14. The securement system of claim 11, wherein the anchor assembly extends outward from an upper surface of the first portion and wherein the anchor axis extends at an acute angle relative to the upper surface of the first portion.

15. The securement system of claim 11, wherein the at least a portion of an anchor shaft of the anchor assembly and securement member are encased in the block.

16. A method of securing a guy wire attached to a guy coupler plate of an anchor assembly, the method comprising:

providing a securement system including at least one securement member having an anchor portion and a securing portion, the securing portion defining an anchor axis;

attaching the anchor portion of the securement member to the guy coupler plate;

placing a portion of the anchor assembly and the securement member within a curable material and curing the curable material to form a block wherein the block comprises a base pad defining a first side, a second side opposite the first side along a first direction, and an upper surface, as well as a first portion extending upwards from the upper surface of the base pad and defining a first side, a second side opposite the first side along the first direction, and an upper surface opposite the base pad that extends from the first side of the first portion to the second side, wherein the first and second sides of the first portion are positioned between the first and second sides of the base pad along the first direction, and the guy coupler plate is positioned above the upper surface of the first portion.

17. The method of claim 16, wherein the base pad and the first portion form a channel adjacent to at least one side of the first portion.

18. The method of claim 17, further comprising attaching a back wall at one end of the first portion, wherein the back wall extends upward relative to the base pad to close one end of the channel.

19. The method of claim 16, wherein the anchor axis extends at an acute angle relative to an upper surface of the first portion.

* * * * *